United States Patent [19]

Bertoli et al.

[11] Patent Number: 4,545,191

[45] Date of Patent: Oct. 8, 1985

[54] SPLICER DEVICE TO SPLICE TEXTILE YARNS MECHANICALLY

[75] Inventors: Luciano Bertoli, Salo'; Roberto Badiali; Claudio Speranzin, both of Pordenone, all of Italy

[73] Assignee: Officine Savio SpA, Pordenone, Italy

[21] Appl. No.: 583,393

[22] Filed: Feb. 24, 1984

[30] Foreign Application Priority Data

Mar. 28, 1983 [IT] Italy ..... 83357 A/83

[51] Int. Cl.[4] ..... D01H 15/00

[52] U.S. Cl. ..... 57/22; 57/261

[58] Field of Search ..... 57/22, 261

[56] References Cited

U.S. PATENT DOCUMENTS 4,170,103 10/1979 Norris et al. ..... 57/22 X 4,341,066 7/1982 Baumgartner ..... 57/22

4,386,494 6/1983 Felix ..... 57/22

4,407,117 10/1983 Garnsworthy ..... 57/22

4,494,367 1/1985 Badiali ..... 57/22

4,499,715 2/1985 Chardon et al. ..... 57/22

*Primary Examiner*—Donald Watkins

*Attorney, Agent, or Firm*—Wegner & Bretschneider

[57] ABSTRACT

This invention concerns an improved splicer (10) to splice textile yarns mechanically, the splice being obtained by coupling two single untwisted yarns (70–71) and reapplying the twists thereafter, part of such single yarns (70–71) being untwisted until twists of a sign opposite to the original twists have been imparted, such part then being doubled and remaining tails (270–271) being obtained, the doubled tract being then retwisted by imparting a required value of twist.

19 Claims, 17 Drawing Figures

SPLICER DEVICE TO SPLICE TEXTILE YARNS MECHANICALLY

Figures 1, 6:
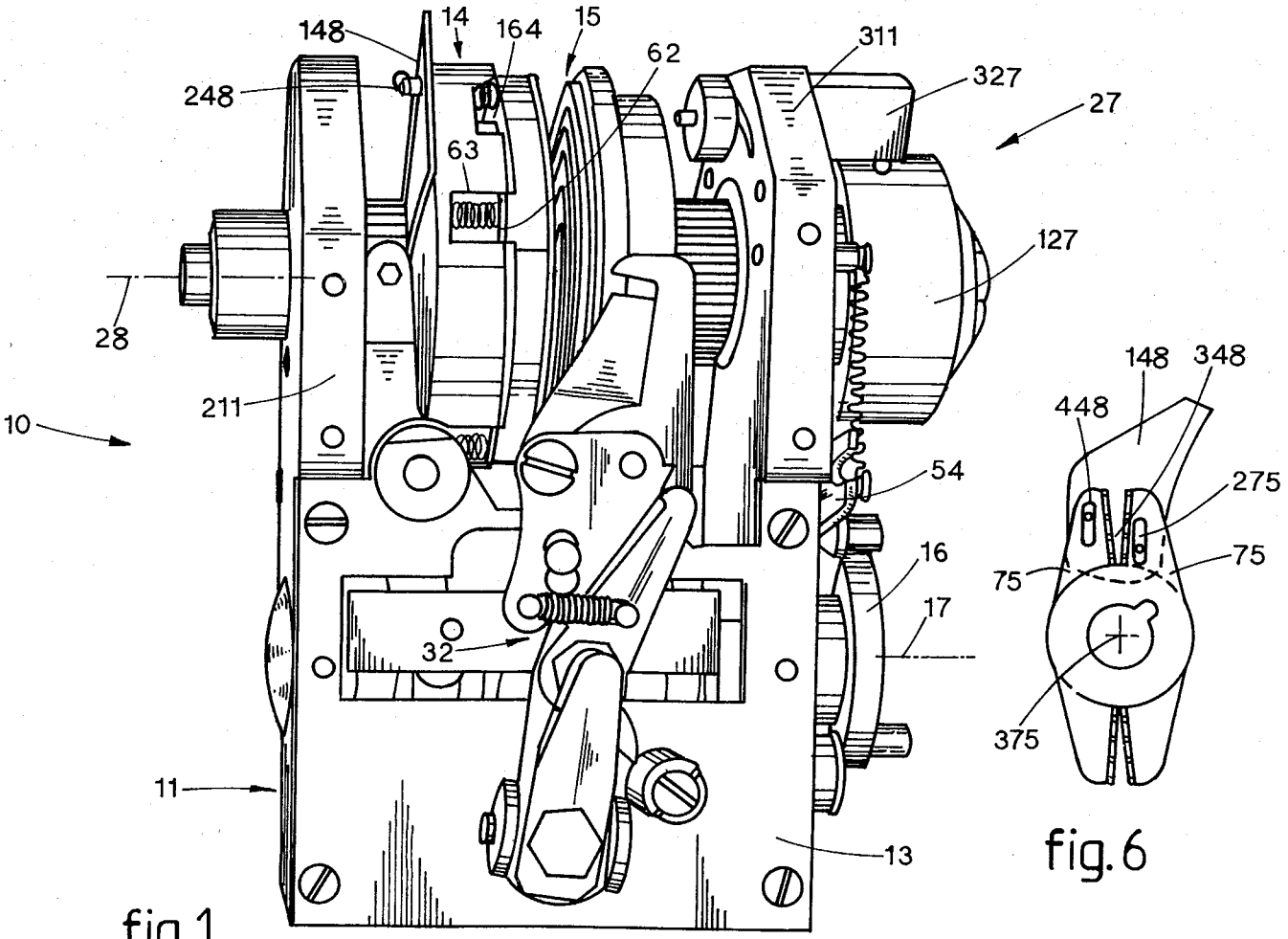

This invention concerns an improved splicer device to splice textile yarns mechanically. To be more exact, the invention concerns a device suitable for splicing two yarns by disassembling and recomposing the twists in the yarn, the whole being obtained mechanically.

Splicer devices using air are known which employ a turbulence chamber within which the fibres of the yarns are disassembled and intermingled so that a splice of the yarns is obtained.

Mechanical splicer devices are also known which make fisherman's knots or knots of another type between the yarns to be spliced.

In particular, mechanical splicer devices are known which disassemble and recompose the yarns by rolling them between two elements rotating, rolling or sliding against each other in opposite directions, In this type of device the disassembly and recomposition of the yarns take place advantageously between zones well defined by such pairs of elements.

For example, European Pat. No. 81301964.3 (CSIRO) is known and discloses a device in which the untwisting and retwisting of yarns positioned parallel to or crossed over each other are carried out by a pair of counterrotating disks.

Owing to the disk-wise conformation of the means employed to untwist and retwist the yarns, if the device is to work properly, the tracts of the two yarns placed between the disks have to take up a diametral position crossed over each other within such disks at least in the untwisting phase.

This entails problems of contact between the ends of the yarns at the crossover point and also incomplete superimposition and mutual penetration of the fibres of the remaining tails after the excessive tail ends have been plucked off.

A further disadvantage of this device lies in the fact that the remaining tails after the tail ends have been plucked off are not properly tapered and are therefore ill adapted to good cooperation between the fibres of the two yarns in the area of such remaining tails.

Devices are known which are the subject of earlier patent applications in the name of the present applicant and which employ untwisting and retwisting means having a substantially circular shape, such as rings or disks. In particular, devices are known which disclose a mechanical splicer which obtains a mechanical splice of textile yarns by untwisting, coupling and thereafter retwisting the yarns thus coupled.

In this device the means which perform the untwisting and retwisting consist of a pair of untwisting and retwisting rings and of a pair of retwisting disk means. These latter disk means act within the rings but only in the retwisting phase.

The use of disks for the retwisting enables a retwisting action to be obtained which is suitably spread along the whole zone of the coupling of the two yarns to be spliced.

Moreover, this device provides means to clamp the twists in the tract placed between clamping means in the inner disks and the outer periphery of the rings when the latter are slackened off.

The slackening of the outer rings becomes necessary so as to obtain a plucking apart and/or tearing of the tail ends in such a way that the remaining tails are formed substantially within a zone lying between the opposed facing untwisting and retwisting rings.

The means to clamp the negative twists imparted to the yarns serve purposely to prevent the loss of the negative twists in the tracts of yarn not to be plucked and/or torn at the moment when the rings are opened.

However, the device disclosed in the cited patent application involves various disadvantages.

One disadvantage lies in the fact that the bringing together of the yarns in the initial phase is carried out by two catches located substantially in correspondence with the inner periphery of the untwisting and retwisting rings. This condition ensures that the yarns are brought together only in the neighbourhood of such inner periphery but does not ensure a secure control of the closeness of the two yarns to each other in the middle zone of the device where, owing also to possible friction against the surfaces employed for the retwisting, the yarns may even not be positioned parallel nor perfectly close to each other.

This fact contributes towards the creation of functioning problems and does not always make it possible to obtain a perfect splice.

Another disadvantage of the known cited device consists of the fact that the device does not enable tail ends to be obtained with certainty which are perfectly free of twists before undergoing the plucking and/or tearing action.

This is so because, when the rings are opened for the plucking action, the negative twists built up in the tract between the inner clamping zone corresponding to the central zone of the disks and the outer periphery of the rings are not always balanced by a corresponding number of opposite twists in the free tract of yarn. Thus, when the outer rings are opened, the twists imparted to the free portion of tail end are transferred at least partially to the portion engaged beforehand between the rings, thus reducing the number of negative twists in a manner which cannot be fully controlled, so that there is no certainty that a tail end to be plucked and/or torn is obtained which is free of twists. This condition, as we said earlier, makes it impossible to obtain a remaining tail which is perfectly tapered after the plucking and/or tearing action.

Yet such a remaining tail is necessary so as to obtain a perfectly tapered splice and good cooperation between the fibres of the two yarns.

A further disadvantage of the known device lies in the fact that the means which perform the plucking and/or tearing of the tail ends do not carry out this action in a direction substantially along the axis of the yarn. As a result it is impossible to obtain perfect remaining tails since a plucking and/or tearing action which is not axial can lead to breakages or faults in the fibres.

Yet another disadvantage of this known device lies in the fact that the position of the remaining tails within the device after the plucking and/or tearing action is not controlled at the beginning of the retwisting phase.

In this way there is the possiblity of a wrong positioning of such remaining tails, that is to say, a positioning of the tails not perfectly adjacent to the whole yarn with which the tails are about to cooperate during the retwisting phase.

Such positioning entails imperfect cooperation between the fibres of the remaining tail and the fibres of the other whole yarn, so that the ends of the splice are thus not perfect.

So as to obtain a remaining tail having a substantially slender, tapered shape, the present invention provides means able to ensure that substantially no twist is present, after the outer rings have been slackened off, in the tract of the tails affected by the plucking and tearing.

According to the invention this condition is obtained by providing auxiliary means to balance the twists. Such means can consist, for instance, of grippers or other means able to clamp the yarn and located at a suitable distance from the outer periphery of the rings.

It is possible in this way to create a tract of controlled tail end in which a number of twists is built up that is equal to, and has the opposite sign to, the number of twists which are built up in the tract of tail end located between the inner clamping means and the outer periphery of the rings.

Such a control is made possible by conditioning the momentary phase of actuation of the means which balance the twists.

In this way, when the rings are slackened off, the twists, having opposite signs in the two tracts of tail end affected inside and outside the rings respectively, are balanced, and a tract of yarn substantially free of twists is obtained.

So as to enable the twists to be thus balanced and so as to overcome the friction of the tail ends to be plucked against the surfaces on which the tail end lies in contact, the invention envisages that the tail end itself is tensioned. This can be done by a suitable movement of the means which balance the twists.

Moreover, such movement can lead, according to the invention, to a prior plucking or mutual sliding of the fibres of the tail ends, thus facilitating the formation of tapered remaining tails thereafter.

The tail ends then undergo an action of plucking and/or tearing by suitable means so as to obtain tapered remaining tails.

The words "plucking and/or tearing" are to be understood as meaning that the operation of removal of the tail ends can have a plucking aspect as well as a tearing aspect and that there are plucking in the case of short fibres and tearing in the case of very long fibres, whereas in intermediate cases there can be both plucking and tearing together.

The present invention envisages plucking and/or tearing means exerting an action substantially along the axis of the yarn at least momentarily in such a way as to make a plucking action possible together with axial sliding of the fibres against each other. The breakage of a great part of the fibres is thus avoided, and suitably reduced remaining tails are therefore obtained.

In the case of particular types of yarn the invention visualizes the ability to eliminate excessive tail ends by a shearing action alone or perhaps together with a plucking and/or tearing action.

The device of the invention envisages means to bring the remaining tails together, such means consisting, for instance, of pairs of comb means or equivalent means able to bring the remaining tails together with the whole yarn with which such remaining tails have to cooperate. In this way, the fibres of the two yarns at the start of retwisting can cooperate closely in the zone with the remaining tails without any risk of a wrong winding effect which would lead to the superimposition of the remaining tail on the whole yarn.

Furthermore, the present invention envisages advantageously the ability to regulate the phases of momentary action of the auxiliary means cited earlier, that is, the means intended to balance the twists in the tracts of yarn affected by the plucking action and the means intended to bring together and to control the remaining tails and the whole yarns.

Momentary control of the action of the means which balance the twists, such control being performed during and at the end of the untwisting, ensures the ability to obtain, in the tract between the outer periphery of the untwisting and retwisting rings and the means which balance the twists, a number of twists exactly equal to, and having the opposite sign to, the number of negative twists present in the tracts of yarn between the portion controlled centrally by the inner clamping means and the outer periphery of the rings, so that such twists and negative twists can be exactly balanced and cancelled mutually when the rings are opened.

In this way the device can be adapted to every kind of yarn by merely regulating, for every quantity of negative twists imparted to the yarn, the phase of momentary action of such auxiliary means that balance the twists.

In the device of the invention all the phases are actuated by actuation means consisting substantially of cams acting within the arc of one revolution of the shaft from which the device gets its motion. One revolution of such shaft corresponds to one complete cycle of splicing of yarns.

The invention is therefore embodied with an improved splicer to splice textile yarns mechanically, the splice being obtained by coupling two single untwisted yarns and reapplying the twists thereafter, part of such single yarns being untwisted until twists of a sign opposite to the original twists have been imparted, such part then being doubled and remaining tails being obtained, the doubled tract being then retwisted by imparting a required value of twist, which splicer comprises:

plate means with untwisting and retwisting ring means cooperating at least momentarily with retwisting means, means to couple yarns, means to pluck and/or tear excessive tail ends, means to clamp twists in the tracts of yarn not to be torn, and inner clamping means acting at least momentarily on two yarns, the splicer being characterized by comprising:

yarn-coupling means consisting of a pair of means which approach each other at least momentarily, twist-balancing means which act at least momentarily on excessive tail-ends, means to cause the approach of remaining tails, which bring the remaining tails close to the adjacent whole yarns, and plucking and/or tearing means which act directly in a direction along the axis of the excessive tail ends at least momentarily.

Figure 2A:
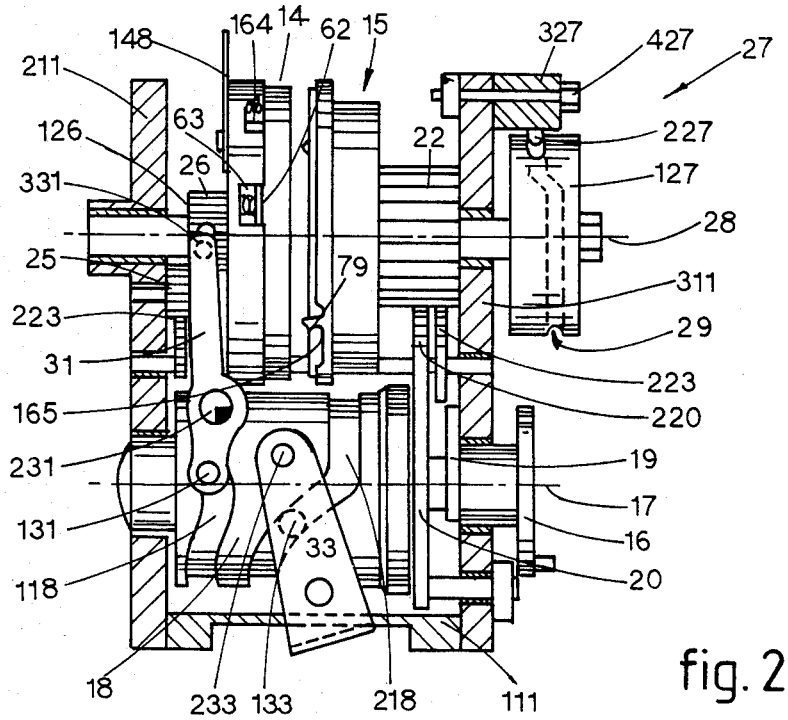
Figure 2C:
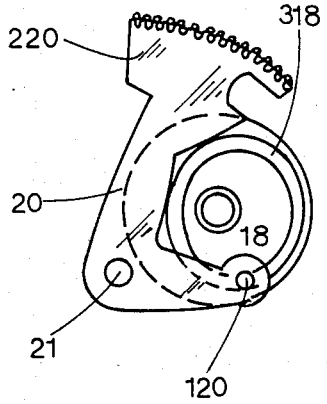
Figure 2B:
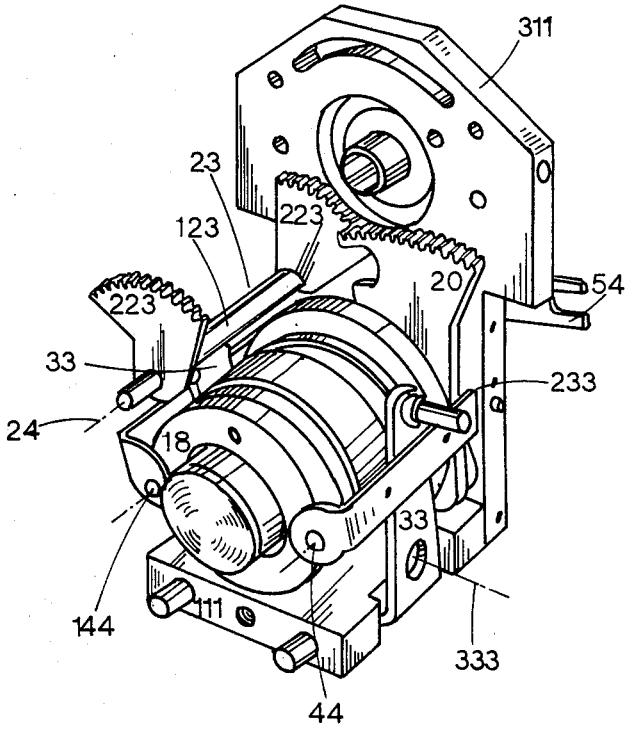
Figure 4B:
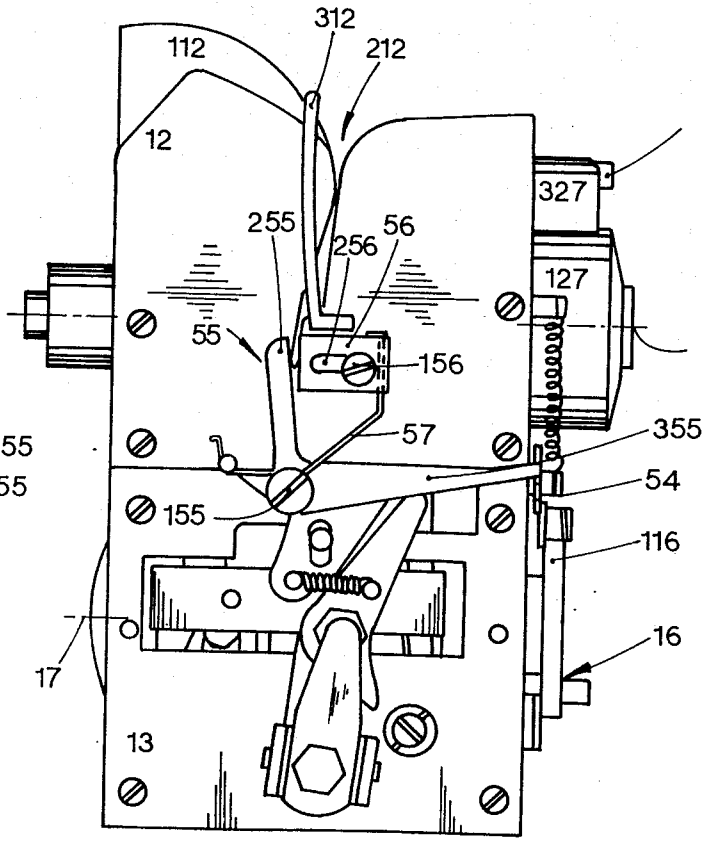
Figure 4A:
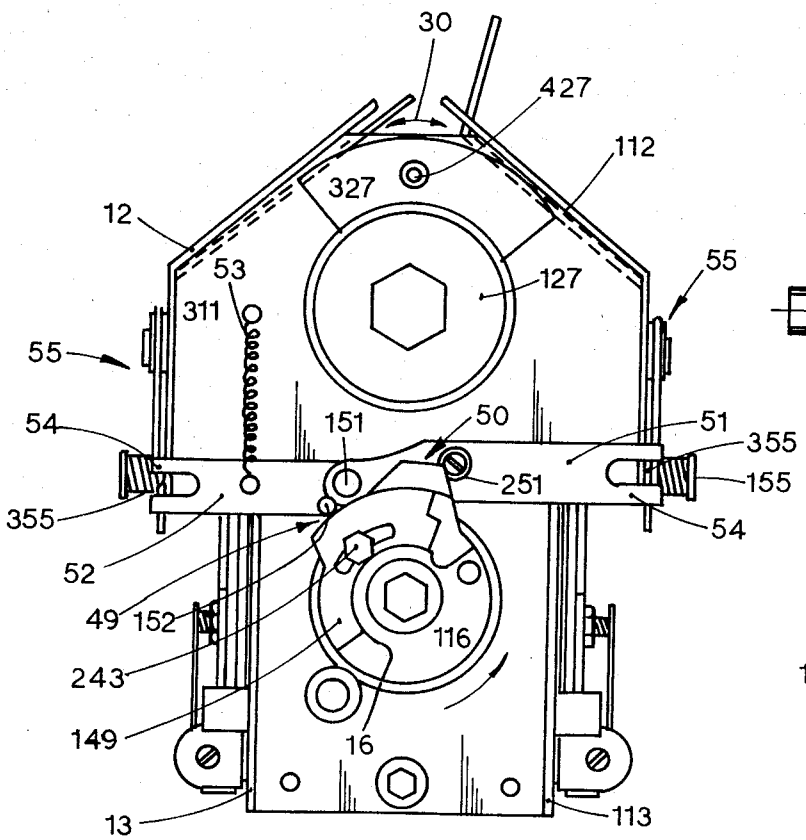

We shall describe hereinafter, as a non-restrictive example, a preferred embodiment of the invention with the help of the attached figures, in which:

FIG. 1 is a three-dimensional view of the device of the invention with the shields removed so as to show the plates and the plucking and/or tearing means;

FIGS. 2*a* to 2*c* give details of the means that actuate the plates;

FIGS. 3*a* to 3*d* show the method of working of the plucking and/or tearing ring means;

FIGS. 4*a* and 4*b* show the means that balance twists together with the relative actuation means;

FIGS. 5*a* to 5*f* show, in particular, the plate means and give diagrams of the working steps;

FIG. 6 shows, in particular, the comb means or means that cause the approach of the remaining tails.

In the figures a splicer 10 has a bearing frame 11, here substantially U-shaped and consisting of a base 111 and two sides 211 and 311, on which the various components are fitted and positioned.

At its front and back the device 10 has shields 12 and 112 (see FIGS. 4*a* to 4*b*) and two support casings 13 and 113 respectively. The shields 12–112, which can consist of one single piece or of several pieces, have been removed in FIGS. 1 and 2*a* to 2*c* so as to enable the inside of the device to be seen partially.

The shields 12–112 comprise positioner notches 212, which are suitably shaped and serve to enable two yarns to be inserted and positioned in the device 10. Positioner rods 312 (FIG. 4*b*) can be included in cooperation with the positioner notches 212.

If the device 10 is not positioned on the normal axis of the processing of the yarn, it can include means to discharge the yarn, which are known in themselves and therefore not shown here. Such discharge means can be within the device 10 and be therefore actuated advantageously by the device itself or be outside and therefore capable of being actuated easily by the machine to which the device 10 is fitted.

Yarns 70–71 are introduced into the device 10 through the positioner notches 212 so that they become positioned between plate means 14 and 15, which are open at the start of the splicing process; in the example shown the yarns 70–71 are positioned substantially parellel.

Introduction of the yarns 70–71 can take place either by means of movable arms or by means of air ducts or through the cooperation of such means, which are already known and used in the prior art of the machines to which the device 10 can be fitted.

In this invention the yarns 70–71 are located substantially parallel to each other, as is shown in the figures, but if so required, they can also be positioned crossed over each other or awry.

The motion arrives in a known manner with the required characteristics through a motion-input wheel 16 having an axis of rotation 17. This motion-input wheel 16 transmits rotation to a drive cam 18 and a cam 19 coaxial with the drive cam 18 (see FIGS. 2*a* to 2*c*).

In this example the drive cam 18 comprises three paths or tracks, namely a path 118 to cause pressure of plate means, a second path 218 to actuate plucking and/or tearing gripper means and a third path 318 to cause rotation of the plate means respectively.

This latter path 318 is located at the front on a face of the cam 18, as shown in FIG. 2*c*, and acts on a stud 120 (FIG. 2*c*) of a lever 20 which rotates plate means and which oscillates on an axis 21.

The lever 20 which rotates plate means includes a toothed segment 220 that meshes with a gear wheel 22 of the plate 15. The gear wheel 22 then transmits its motion by means of motion-transmission means 23, which have an axis 24 of rotation and consist in this case of a shaft 123 and toothed segments 223, to a transmission gear wheel 25 and thence 25 to a gear wheel 26 solidly fixed to the plate 14.

The device 10 comprises a group 27 to regulate untwisting which consists of a cam 127 that cooperates with a pin 227 solidly fixed to a selector 327. The selector 327 can be secured, by rotation on the axis 28 of the plates 14–15, at any required point within a given angular displacement 30 (see FIG. 4*a*) by acting on locking means 427.

If the selector 327 is displaced at an angle, the cooperation of the pin 227 with the lengthwise displacement included in the development of the cam 127 is advanced or retarded. Since the pin 227 is stationary axially, the cam 127, and with it the plate 15, has to move axially to the rotation of the latter.

The selector 327 serves to determine the moment at which the plate, or plate means, 15 has to move lengthwise towards the plate means 14 so as to start the untwisting action on the single yarns, and also serves to determine the moment at which the plate 15 has to retreat so as to end the retwisting action on the spliced yarn.

The conformation of the path 29 on the cam 127 (see FIG. 2*a*) has the effect that between the above two moments the plate means 15 remains substantially halted axially at a specific lengthwise position.

The sequence of gears 22-223-25-26 causes the plate means 14 to rotate in the opposite direction to the plate means 15.

The path 29 serves to make the plate means 15 approach the plate means 14 and, in this example, to carry out part of the mutual interactions of the plate means 15 and 14.

The path 118 of the cam 18 acts on a stud 131 on a lever 31 which can rotate about a pivot 231. This lever 31 together with a stud 331 acts on a hollow 126 cooperating with the stud 331 and present in cooperation with the gear wheel 26 solidly fixed to the plate means 14. This fact enables the plate means 14 to move lengthwise on its axis 28 according to the conditionings provided by the path 118.

Therefore, in view of the above, all the movements of the plates 14–15 are controlled by the paths 318-118-29 respectively employed for rotation of the plates 14–15, for controlling the axial position of the plate 14, and for controlling and regulating momentarily the axial position of the plate 15 respectively.

In FIG. 1 and in greater detail in FIGS. 3*a* to 3*d* are shown the plucking and/or tearing means 32–132, which are called hereinafter the grippers 32–132 for the sake of brevity.

The grippers 32–132 of the invention, as we said above, can be displaced advantageously at least momentarily in a direction substantially axial to the yarn as well.

The steps in the movements of the grippers 32–132 includes substantially the following:

a movement to engage the yarn substantially crosswise to the yarns 70–71 positioned coupled together, a plucking and tearing movement substantially along the axis of the yarns 70–71, the grippers 32–132 being rotated towards the outside of the device 10, a return travel substantially crosswise to the yarns 70–71, the grippers 32–132 being finally opened and the plucked tail ends being discharged by known means.

The movements in directions crosswise and axial to the yarns 70–71 are performed by means of different drive means.

The crosswise movement is actuated by a U-shaped lever 33, which is pivoted at 333 (FIG. 2*b*) and is operated by the path 218 of the cam 18, which acts on a stud 133 of the lever 33. A control pin 233 acts in a slot 134 of a lever 34 rotatably connected at 35 to a gripper body 36 (see FIGS. 3*a* to 3*d*).

The gripper body 36 is rotatably connected at 136 by a fork means 37 to a pivot 237 able to rotate in its turn around an axis 137. In this way the gripper 32 or 132 can rotate about two axes 136 and 137 which are substantially at right angles to each other.

Rotation about the axis 136 is resisted by resilient means 38, which in this example consist of a resilient foil.

The method of working is as follows. The gripper 32–132, which is initially in a position of rest (FIG. 3*a*), is brought to a position to engage an excessive tail end 171 (FIG. 3*b*) owing to the action of the control pin 233.

The lever 34 abuts against a stop 39, and a further displacement of the pin 233 causes rotation of the lever 34 about the pivot 35 together with the lowering of a protrusion 40 which becomes engaged by a hook means 41 with a spring 141.

The lever 34 causes closure of a slidable jaw 42 by means of a pivot 142 with a resilient ring 242, which acts on the slidable jaw 42. At its lower end the slidable jaw 42 is guided by means of a slot 342 cooperating with a pin 442, which is solidly fixed to the gripper body 36 and also acts as a pivot for the hook 41. A nut 542 prevents mutual disengagement of the hook 41 and jaw 42.

The resilient yielding of the ring 242 determines the gripping force applied to the excessive tail end 171.

Axial plucking action is operated by the cam 19 (FIG. 3*c*; see also FIG. 2*a*) which, by acting on a stud 243, causes the opening of two wings 43–143 rotatably anchored at 44–144 respectively on the side frame 311, and also on the side frame 211 which has been omitted in the figure (see also FIG. 2*b*). In the example shown the wing 143 is operated directly by the stud 243 and itself operates the wing 43 by means of a stud 343 cooperating with a slot 443 in the wing 43 itself.

These wings 43–143 act on the bodies 36 of the grippers 32–132 respectively and cause their movement 45 outwards substantially along the axis of the coupled yarns 70–71.

Figure 3A:
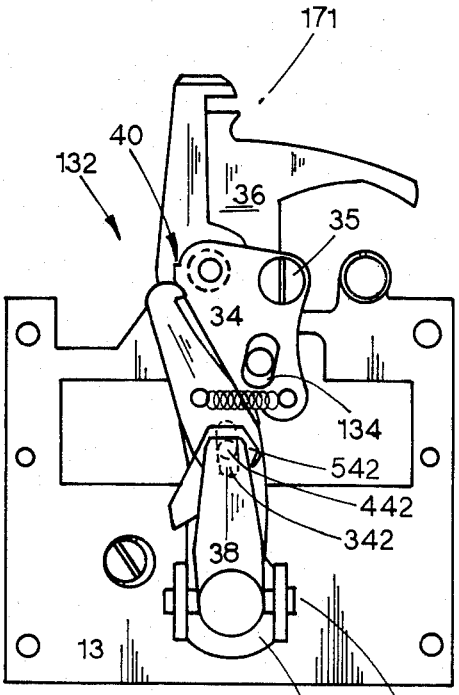
Figure 3B:
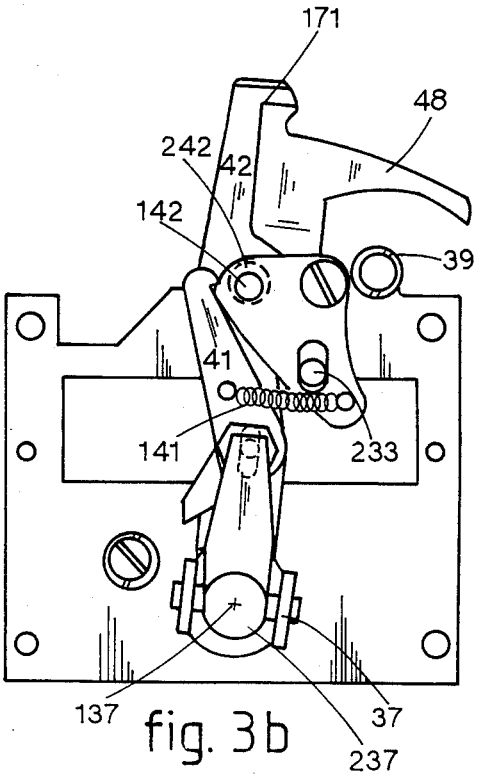
Figure 3C:
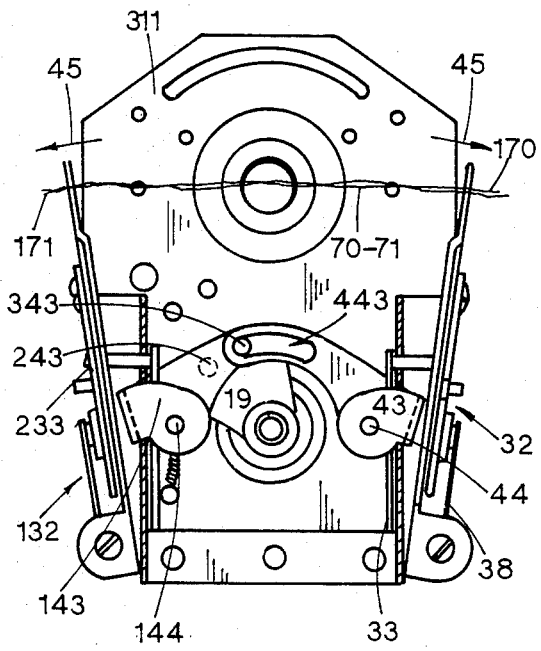
Figure 3D:
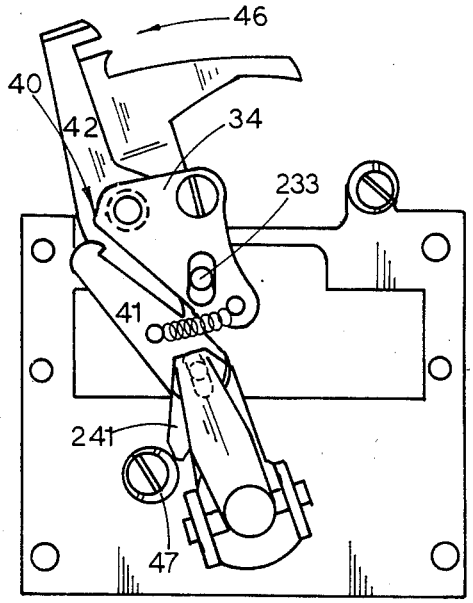

Lastly, when the axial plucking and/or tearing of the excessive tail ends 170–171 has been carried out, the grippers 32–132 return owing to the effect of the control pin 233 (FIG. 3*d*).

At some moment during such return movement 46 the stud 243 is disengaged from the cam 19. As a result, the wings 43–143 close, and the grippers 32–132 rotate about the axis 136 owing to the action of the resilient means 38 and are brought back alongside the casing 13.

At the end of the return movement 46 a tail piece 241 of the hook means 41 strikes against an unclamping abutment 47.

This causes disengagement of the protrusion 40 by the hook 41 and return of the lever 34, with a consequent opening of the slidable jaw 42 and release of the tail end of yarn 171, which is discharged by known means.

In the example shown the gripper 132 comprises a projection 48 intended to cooperate with a lever 148 that actuates combs (see FIGS. 1 and 2*a*).

FIGS. 4*a* to 4*b* show means 55 which equilibrate the twists. A cam 116 made in cooperation with the motion-input wheel 16 has a path 49 obtained on a plate 49 adjustable by means of locking means 249 and also has a stationary path 50, these two paths 49–50 being positioned in sequence.

The cam 116 acts on a stud 151 of an arm 51 rotatably anchored at 251 on the side frame 311. This arm 51 in its turn actuates, with a pin not shown here, an arm 52 rotatably anchored at 152 on the side frame 311.

Return spring means 53 oppose the action of the cam 116. The ends 54 of the arms 51–52, here conformed fork-wise, engage two L-shaped levers 355, one on each side, which have pivots at 155.

The end, or jaw, 255 of the lever 355 faces a slidable block 56 guided by a pin 156 cooperating with a slot 256 in the block 56 and with a return spring 57.

The tail end 170 or 171 of the yarn 70 or 71 becomes positioned between such end 255 and the block 56, the twists in the tail end 170–171 having to be equilibrated as specified earlier in this description.

The method of functioning is as follows: the adjustable plate 149 enables the momentary position of action of means 55 that clamp the twists to be determined.

The path 49 acts on the stud 151 and causes rotation of the arms 51–52 against the action of the returnspring means 53.

The tail end 170 or 171 of yarn, which was located initially between the end 255 of the lever means 55 and the block 56, now becomes gripped between 255 and 56. When the path 50 engages the stud 151, the arms 51–52 rotate further, and with them the levers 355, which thrust with their ends 255 against the blocks 56. The tail ends 170–171 are now put under tension, this tension being made axial by the abutment formed with the edge of the positioner notch 212; the tail ends 170–171 also undergo an action of prior plucking which facilitates the subsequent operation of the plucking and/or tearing means 32–132.

As specified earlier, the tensioning of the tail end 170–171 has the purpose of enabling the twists to be equilibrated as between the zone extending from the outer periphery of the untwisting and retwisting rings 58–59 to the point of engagement of the yarn between the end 255 of the lever and the block 56 and the zone extending from the outer periphery of the rings 58–59 to the inner clamping means 78.

According to the invention it is possible for the axial tensioning to be carried out by providing a direct axial action of the lever means 55 on the tail ends 170–171 instead of the cited axial action owing to the effect of the abutment at 212 against which the tail end 170–171 presses.

The provision of an action that can be momentarily determined for the path 49 has the result that it is possible to determine as required the moment at which a tract with controlled twists is created in the tail ends 170–171 of yarn during, or at the end of, untwisting.

As we said before, it is possible in this way to determine consequently the number of such twists so that, when the rings 58–59 are opened, the twists in the controlled tract balance the opposite twists in the tract between the periphery of the rings 58–59 and the inner clamping means 78 (see FIG. 5*a*), thus leading to excessive tail ends 170–171 substantially free of twists before they are plucked and/or torn.

According to a variant, which is not shown here but remains within the scope of the invention, it is possible to make adjustable the point at which the tail ends 170–171 are gripped by the means 55 that balance the twists by providing such means 55 with a position that can be adjusted axially to the tail ends 170–171.

In this way the length of the tract of tail end 170–171 positioned between the rings 58–59 and the means 55 to equilibrate twists can be determined.

In its turn this length will determine the number of controlled twists imparted to such tract of tail end 170–171, by itself or in cooperation with the adjustment of the momentary action of the lever means 55 as described above.

After the tail ends 170–171 of yarn have been engaged by the plucking and/or tearing grippers 32–132, the cam 116 actuates the opening of the means 55 that equilibrate twists. In this way the tail ends 170–171, being free of twists, remain engaged by the grippers 32–132 alone. The plucking and/or tearing operation and discharge of excess tail ends 170–171 can then take place.

FIGS. 5*a* to 5*f* show details of the plate means 14 and 15. These plate means 14–15 can be the same as each other or have different special characteristics and/or dimensions.

The dimensions of the plate means 14–15 and their special characteristics (of the ring means 58–59 and retwisting disk means 60–61) can also vary with variations in the type of yarn and/or mean length of the fibres.

Both plate means 14–15 comprise advantageously an untwisting-retwisting ring means 58–59 respectively and a retwisting disk means, or disk, 60–61 respectively.

In the example shown the ring 59 is embodied in cooperation with and solidly fixed to the disk 61.

The ring means 58–59 and disks 60–61 are equipped with means which prevent their rotation and involuntary detachment in relation to their shells 64–65.

Figures 5A, 5B, 5C:
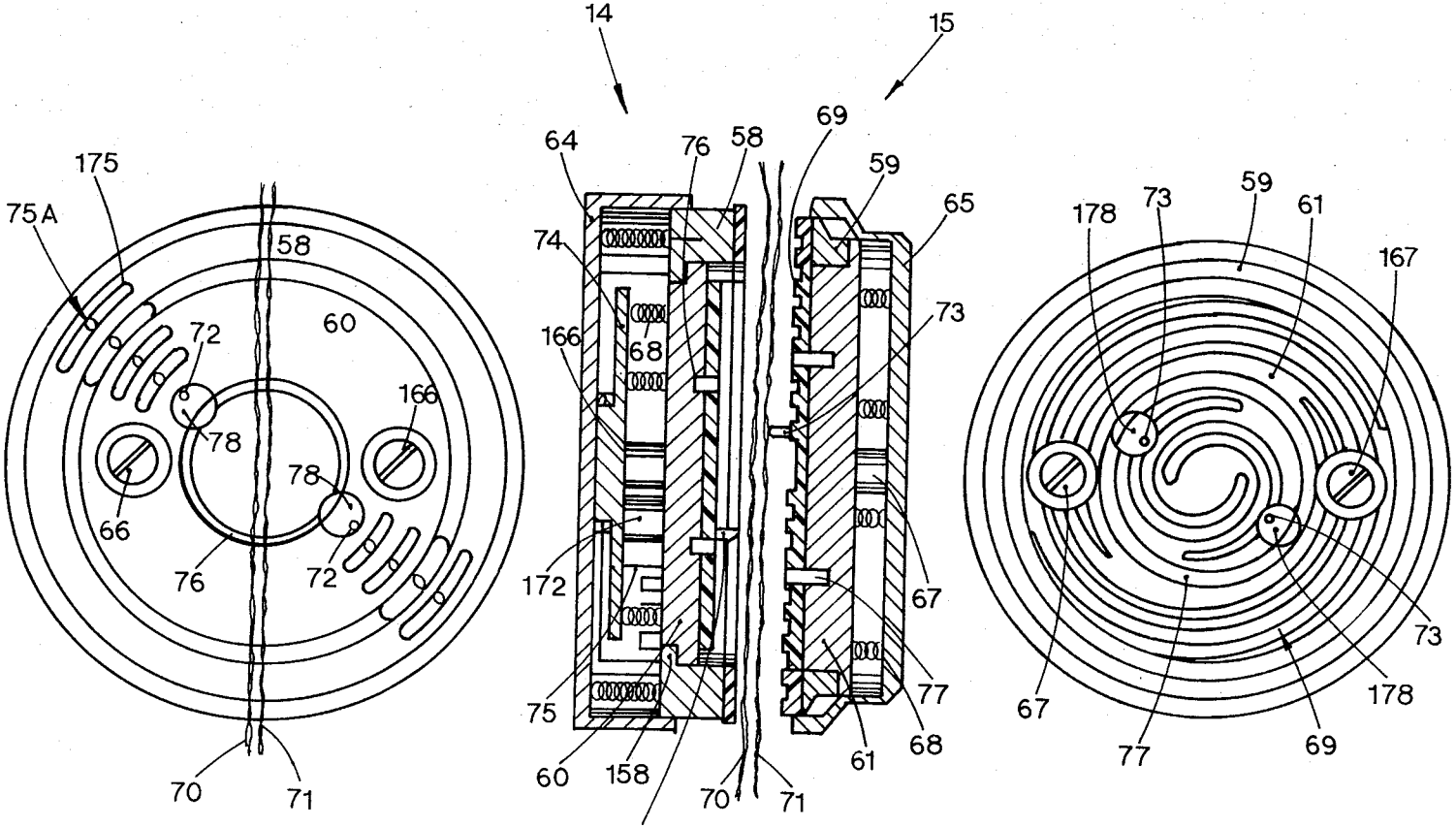

In the example shown radial swellings 62 prevent undesirable rotation of the ring 58, being engaged in recesses 63 in the shell 64 (see FIGS. 1 and 2*a*); a stepped portion 158 prevents disengagement of the ring 58 (FIG. 5*b*).

Screws 66–166 and 67–167 prevent rotation and detachment of the disks 60 and 61 respectively, the heads of these screws being sunk in the disks 60–61 respectively, and the screws 66–166 and 67–167 being engaged in the shells 64–65 respectively.

The disk 60, ring 58 and disk 61/ring 59 assemblage are kept in position by resilient means, here consisting of compression springs, 68.

The retwisting means, or disks, 60–61 can be flat as in FIG. 5*a* or be equipped with specialized processing means 69 according to specific requirements, as in FIG. 5*c*. Such processing means 69 in this case are conformed advantageously with stripes having a development in one half opposite to that of the other half of the retwisting means 61, the stripes here having a spiral form.

These stripes will be advantageously such as to comprise spaces between one processing means 69 and its neighbour, the spaces being such that they make clear a lengthwise drawing action on the fibres and outer hairs of the yarns 70–71.

According to the invention the retwisting means 60 and/or 61 contain means 72–73 to couple yarns and also inner means 78 to clamp the central tract of the yarns 70–71. The means 72–73 to couple yarns are provided in any required position within the inner periphery of the rings 58–59, their position possibly being adjustable.

The inner clamping means 78 of the invention can be obtained in cooperation with the yarn-coupling means 72–73, as shown in the figure, or can be envisaged as being separate without departing thereby from the scope of the invention.

The invention may possibly envisage the ability to regulate the extreme positions of such inner clamping means 78. According to the invention it is also possible to visualise means performing both the functions of coupling and clamping the yarns, carrying out the clamping, for instance, with a circumferential action of the coupling means 72–73 themselves.

According to the invention it is possible to obtain a clamping action not only by a displacement substantially axial to the disks 60–61, but also by a displacement substantially parallel to the disks 60–61, of the clamping means 78, but such two displacements could also be combined.

The means 72–73 to couple yarns consist, in this case, of pairs of pins, this term being used from now on for the sake of brevity.

In the example shown the inner clamping means 78 consist of a flat end surface of a pin support 72 (see FIGS. 5*d*, 5*e* and 5*f*), which engages the yarn against the retwisting disk means 61. The latter can include raised portions 178 coinciding with the area for clamping the yarns and facing and opposed to the surfaces 78.

The pins 73 are solidly fixed to the disk 61 and can move therewith in an axial direction too. The pins 72 together with the pin supports 172 including the inner clamping means 78 are secured to a circular plate 74 solidly fixed to the shell 64, and there is therefore a relative axial displacement as between the pins 72 and the disk 60 when the mutual axial positions of the shell 64 and disk 60 are varied.

It remains within the scope of the invention to envisage pairs of pins 72 and/or 73 retractable within supports 172 of the disk 61. In this case it will not be necessary to have circumferential hollows 77 and/or 76.

It also remains within the scope of the invention to envisage pins 72–73, or equivalent means, independent of the disks 60–61 and having any required momentary action on the yarns.

The plate 14 also includes means 75 to bring the remaining tails together. According to the invention these means 75 to bring the tails 270–271 together can be visualized as cooperating with the plates 14 and/or 15 or can be outside the plates 14–15 and acting momentarily between separated disks 60–61 and rings 58–59.

Such means 75 in this example consist of combs. These combs are normally closed (position 75A in FIG. 5*a*) and are opened by the action of the projection 48 of the gripper 132 on the lever 148 before the excessive tail ends 170–171 are plucked and/or torn.

FIG. 6 shows in particular the combs 75 arranged so as to counterrotate on the same axis 375.

The lever 148 having its pivot at 348 comprises two pins 448 on opposite sides of the pivot 348. These pins 448 are engaged in slots 275 in the combs 75.

FIG. 6 shows how actuation of the lever 148 causes rotation of the combs 75 through the action of the pins 448 in the slots 275 and thus the opening or closure of the combs 75 themselves, depending on the direction of such actuation. In this example the opening takes place by anti-clockwise rotation of the lever 148 by the projection 48 of the gripper 132 (see FIGS. 1 and 3*a* to 3*d*), whereas closure takes place through the action of a return spring 248 (see FIG. 1).

Figure 5F:
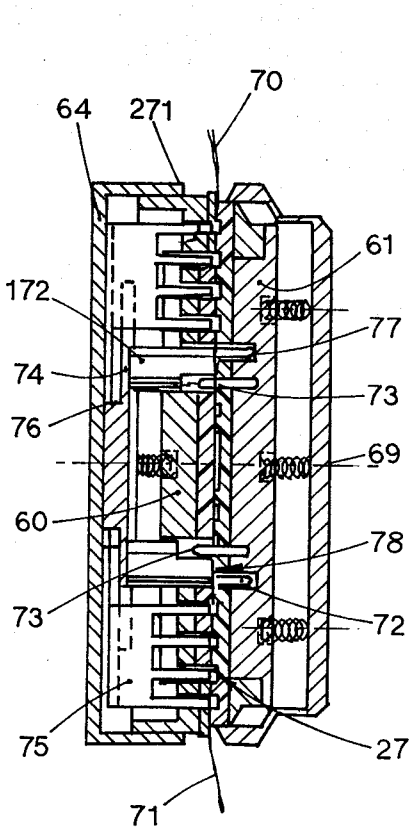
Figure 5E:
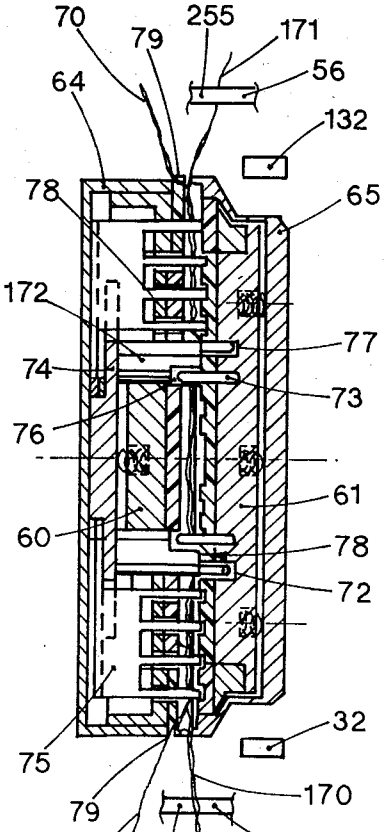
Figure 5D:
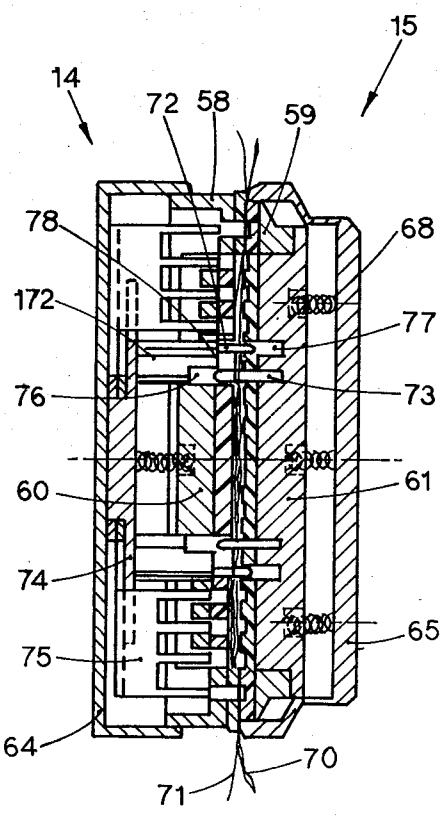

The working of the device 10 is shown diagrammatically in FIGS. 5*a* to 5*f* in which FIG. 5*b* shows the phase of introduction of yarns 70–71, FIG. 5*d* shows the untwisting action, FIG. 5*e* shows the yarn-clamping action and FIG. 5*f* shows the start of the retwisting action.

FIGS. 5*a* to 5*f* show the plates 14–15 in a direction crosswise to the development of the yarns 70–71 as inserted into the device 10, that is to say, the view is that of FIG. 1 but from above. With the yarns thus positioned a rotary motion comes to the motion-input wheel 16. This motion is advantageously continuous but could also be transmitted in a variable or pulsating manner.

The rotation of the wheel 16 sets in rotation the cam 18, which acts on the various means in relation to the process.

Substantially only the ring means 58–59 work during the untwisting phase (FIG. 5*d*).

At the end of the untwisting phase the pins 72–73 have brought the untwisted yarns 70–71 together in the meanwhile, thus permitting the control of the central zone of the yarns 70–71, which are substantially parallel and in contact with each other.

In the example shown the pins 72–73 are lodged in circumferential hollows 77–76 respectively made in the disks 61–60 respectively.

The supports 172 of the pins 72 and also the built-up portions 178, when included, are shaped in such a way that they do not interrupt the continuity of such hollows 76–77.

As soon as the yarns 70–71 have been untwisted and brought together (FIG. 5*d*), the plates 14–15 are thrust against each other. Thus the clamping means 78 thrust the disk 61 together with the ring 59 back into the shell 65, while the screws 67–167 prevent the disk 60 from advancing; therefore the ring 58 too cannot advance as it is withheld by the stepped portion 158.

FIG. 5*e* does not show the screws 67–167 so as to keep this figure clear, but such screws 67–167 press with their heads against the disk 60 and stop the disk 60 from coming into contact with the disk 61, as we said earlier.

The yarns 70–71 are clamped in this way by the surfaces 78–178 in their central tract located between such means 78 but are not constrained by the surfaces of the disks 60–61 and rings 58–59.

The means 55 to balance twists have, in the meantime, engaged the excessive tail ends 170–171, as is shown diagrammatically in FIG. 5*e*.

The combs 75, which are already in a circumferential position corresponding with the yarns 70–71 at the end of untwisting, are opened by the action of the projection 48 on the lever 148 and protrude through the circumferential slots 175 in the disk 60 and ring 58 when the plates 14–15 are pressed against each other as in FIG. 5*e*.

During the phase of the plucking and/or tearing of the excessive tail ends 170–171 the shells 64–65 are in circumferential contact with each other, but the outlets 164 and 165 respectively (see FIGS. 1 and 2*a*) permit the action of plucking and/or tearing the tail ends 170–171, leaving a free passage for the excess tail ends 170–171.

Instead, the means 79 to block twists constrain against the shell 64 the portion of yarns 70–71 not to be torn and (FIG. 5*e*) prevent the negative twists contained in the tract of the yarns 70–71 located between the outer periphery of the rings 5–59 and the inner clamping means 78 from becoming lost by spreading along the yarns 70–71, through the outlets 164–165 and outside the rings 58–59 and from being cancelled owing to the presence of the positive twists existing outside.

The clamping action of the inner clamping means 78 has the effect that the remaining tails 270–271 are tapered from a position of greatest thickness near the means 78 themselves to an end position near the outer periphery of the rings 58–59.

The grippers 32–132 carry out the plucking and/or tearing action, as in FIG. 3*c*, after the opening of the means 55 to balance twists, and return as in FIG. 3*d*.

The plucked tail ends 170–171 are discharged by known means when the grippers 32–132 are opened.

The return of the gripper 132 causes disengagement of the lever 148 by the projection 48 and a consequent closure of the combs 75 which bring the remaining tails 270–271 close to the yarns 71–70 respectively.

The plates 14–15 are now opened slightly (FIG. 5*f*) and the surfaces 78 press no longer against the disk 61; moreover, the disks 60–61 come into contact with each other, as also do the rings 58–59.

The combs 75 retreat, in conjunction with the withdrawal of the plate 14, to which they are solidly fixed axially, below the surface of the disk 60 and thus free the remaining tails 270–271 and yarns 71–70 now lying close to each other. Thus the yarns 70–71 are now controlled closely along the whole extent of the disks 60–61 and rings 58–59.

FIG. 5*f* shows the start of the retwisting phase, the means 78 no longer clamping the yarns 70–71, while the disks 60–61 and rings 58–59 press against the yarns 70–71.

During the retwisting phase, which is carried out, as is known, with a rotation opposite to that of the untwisting phase, both the ring means 58–59 and the respective retwisting disk means 60–61 cooperate in obtaining the required degree of retwisting.

During retwisting the pins 72–73 withdraw from each other and run within their respective hollows 77–76, thus ensuring no contact with the coupling yarn.

As we said earlier, the conformation and sizes of the rings or ring means, 58–59 and the conformation, sizes and special characteristics of the retwisting disks means, or disks, 60–61 will vary to suit the mean characteristics of the fibres composing the yarns 70–71 to be spliced.

The scope and ability of the invention cover the provision of a differentiated speed of rotation as between one plate means and the other or as between a ring means and a retwisting means.

It is also within the capability of the invention to provide constant reciprocal speeds (angular speeds if the means are circular) or speeds which can be varied over a period of time throughout the phases or in the individual phases, or else pulsating speeds.

We claim:

1. A splicer for mechanically splicing textile yarns, wherein splicing is obtained by coupling two single untwisted yarns and reapplying the twists thereafter, a part of said single yarns being untwisted until twists of a sign opposite to the original twists have been imparted, such part then being doubled and remaining tails being obtained, the doubled tract being then retwisted by imparting a required value of twist, said splicer comprising:

plate means having untwisting and retwisting ring means cooperating at least momentarily with retwisting means, yarn-coupling means consisting of a pair of means that approach each other at least momentarily, means to pluck and/or tear excessive tail ends of said yarns, said plucking and/or tearing means acting directly in a direction along the axis of the excessive tail ends at least momentarily, means to clamp twists in the tracts of yarn not to be torn, inner clamping means acting at least momentarily on two yarns, twist-balancing means that act at least momentarily on excessive tail ends, and means to cause the approach of remaining tails, which bring the remaining tails close to the adjacent whole yarns.

2. The splicer of claim 1 wherein said plucking and/or tearing means comprise at least:

gripper body means capable of moving at least in one direction substantially crosswise to the axis of said yarns so as to clamp the excessive tail ends and at least in another direction substantially axial to said yarns so as to pluck and/or tear the excessive tail ends, movable jaw means that cooperate with the gripper body means so as to clamp and to pluck and/or tear the excessive tail ends, means to control crosswise movement, and means to control axial movement.

3. The splicer of claim 2, further comprising:

lever means that actuate said movable jaw means, hook means that clamp said lever means at least momentarily in a position corresponding with the closure of said movable jaw means, and spring means to cause return of said hook means.

4. The splicer of claim 1, wherein said yarn-coupling means are positioned within the outer periphery of said retwisting means and act at least momentarily in the neighborhood of the end positions of said inner clamping means.

5. The splicer of claim 1, wherein said yarn-coupling means consist of pairs of pins solidly fixed at least momentarily to said retwisting means.

6. The splicer of claim 5 wherein each of said retwisting means has at least one circumferential hollow for momentary lodgement corresponding with the position of said yarn-coupling pins relative to the facing opposed retwisting means.

7. The splicer of claim 1, wherein said yarn-coupling means consist of pairs of pins interacting with said retwisting means in an independent manner.

8. The splicer of claim 1, wherein said inner clamping means are capable of cooperating with at least one pair of said yarn-coupling means.

9. The splicer of claim 1, wherein said yarns are clamped by axial displacement of at least means that support said yarn-coupling means.

10. The splicer of claim 1, wherein said yarns are clamped by sideways displacement of said yarn-coupling means.

11. The splicer of claim 1, wherein said inner clamping means are independent of said yarn-coupling means.

12. The splicer of claim 1, wherein said means that balance twists comprise at least means capable of gripping and tensioning said excessive tail ends in a controlled manner at least momentarily.

13. The splicer of claim 1, wherein said means capable of gripping and tensioning the excessive tail ends are displaced along the axis of said excessive tail ends so as to tension same.

14. The splicer of claim 1, wherein, so as to tension said excessive tail ends, said means capable of gripping and tensioning the excessive tail ends cooperate with abutments intermediate to a positioner notch that supports said excessive tail ends.

15. The splicer of claim 1, wherein said twist-balancing means comprise resiliently yielding movable abutment means.

16. The splicer of claim 1, further comprising adjustable cam means to regulate the start of the phase of momentary action of said twist-balancing.

17. The splicer of claim 1, wherein said means to cause approach of said remaining tails comprise pairs of opposed means in diametrically opposite positions, said yarns and the respective remaining tails that are coupled to said yarns being positioned within each of the above pairs of means.

18. The splicer of claim 17, wherein said pairs of means located in said means that cause approach of the remaining tails consist of pairs of combs.

19. The splicer of claim 1, wherein said means that cause approach of the remaining tails extend from the neighborhood of said inner clamping means at least to the outer periphery of said retwisting means.

* * * * *